US005992985A

United States Patent [19]

Young et al.

[11] Patent Number: 5,992,985

[45] **Date of Patent: *Nov. 30, 1999**

[54] VARIABLE PRESSURE CONTROL FOR INK REPLENISHMENT OF ON-CARRIAGE PRINT CARTRIDGE

[75] Inventors: Mark E Young, Santa Rosa, Calif.; Rosa Calatayud; Ignacio de Olazabal, both of Barcelona, Spain

[73] Assignee: Hewlett-Packard Company, Palo Alto, Calif.

[ * ] Notice: This patent is subject to a terminal disclaimer.

[21] Appl. No.: 08/806,749

[22] Filed: Mar. 3, 1997

Related U.S. Application Data

[63] Continuation-in-part of application No. 08/615,903, Mar. 14, 1996, Pat. No. 5,777,648, and a continuation-in-part of application No. 08/454,975, May 31, 1995, Pat. No. 5,745,137.

[51] Int. Cl.[6] ..... B41J 2/175

[52] U.S. Cl. ..... 347/85

[58] Field of Search ..... 347/7, 85, 86, 347/87

[56] References Cited

U.S. PATENT DOCUMENTS

| | | | |
|---|---|---|---|
| 3,930,258 | 12/1975 | Dick et al. | 346/75 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/43 |
| 4,929,963 | 5/1990 | Balazar | 347/89 |
| 4,959,667 | 9/1990 | Kaplinsky | 347/87 |
| 4,967,207 | 10/1990 | Ruder | 347/7 |
| 4,968,998 | 11/1990 | Allen | 347/87 |
| 4,970,528 | 11/1990 | Beaufort et al. | 346/25 |
| 5,121,132 | 6/1992 | Pan et al. | 347/87 |
| 5,136,305 | 8/1992 | Ims | 347/7 |
| 5,280,300 | 1/1994 | Fong et al. | 347/87 |
| 5,329,294 | 7/1994 | Ontawar et al. | 397/87 |
| 5,359,353 | 10/1994 | Hunt et al. | 347/86 |
| 5,367,328 | 11/1994 | Erickson | 347/7 |
| 5,369,429 | 11/1994 | Erickson | 347/7 |
| 5,650,811 | 7/1997 | Seccombe et al. | 347/85 |
| 5,745,137 | 4/1998 | Scheffelin et al. | 347/85 |
| 5,777,648 | 7/1998 | Scheffelin et al. | 347/87 |

FOREIGN PATENT DOCUMENTS

| | | | |
|---|---|---|---|
| 0 237 787 A3 | 2/1987 | European Pat. Off. . | |
| 0 519 664 A2 | 6/1992 | European Pat. Off. . | |
| 0536980A2 | 4/1993 | France | B41J 2/175 |
| 93 00 133 U | 7/1993 | Germany . | |
| 61-12347A | 1/1986 | Japan | B41J 3/04 |

OTHER PUBLICATIONS

Patent Abstracts of Japan, published by the European Patent Office, Publication No. 60248355, Publication Date: Sep. 12, 1985.

*Primary Examiner*—N. Le
*Assistant Examiner*—Anh T. N. Vo

[57] ABSTRACT

A variable height reservoir system that allows for reliable ink replenishment to an on-carriage pen reservoir from an off-carriage ink reservoir on an as needed basis. The off-carriage reservoirs are mounted on a platform that is actively moved up and down in a vertical motion. A pen cartridge with an internal spring to provide vacuum pressure is intermittently connected to an off-carriage reservoir, by movement of the pen carriage to a refill station for ink replenishment. In the refill station, a valve is engaged into the pen, thus connecting the ink reservoir to the pen cartridge. Using only the vacuum pressure present in the pen cartridge, ink is pulled into the pen from the reservoir. The ink replenishment occurs in a first stage with the reservoir placed very close to the pen cartridge elevation, with only a small offset between the top of the ink reservoir and the pen nozzles. This small offset distance ensures flow of ink into the pen cartridge, and results in acceleration of ink into the pen, decreasing the fill time. The pen can be overfilled, decreasing the pen vacuum pressure such that high print quality will be sacrificed. The reservoir is then lowered which results in a small amount of ink moving back into the reservoir, raising the vacuum pressure into the appropriate range.

20 Claims, 11 Drawing Sheets

FIG. 6
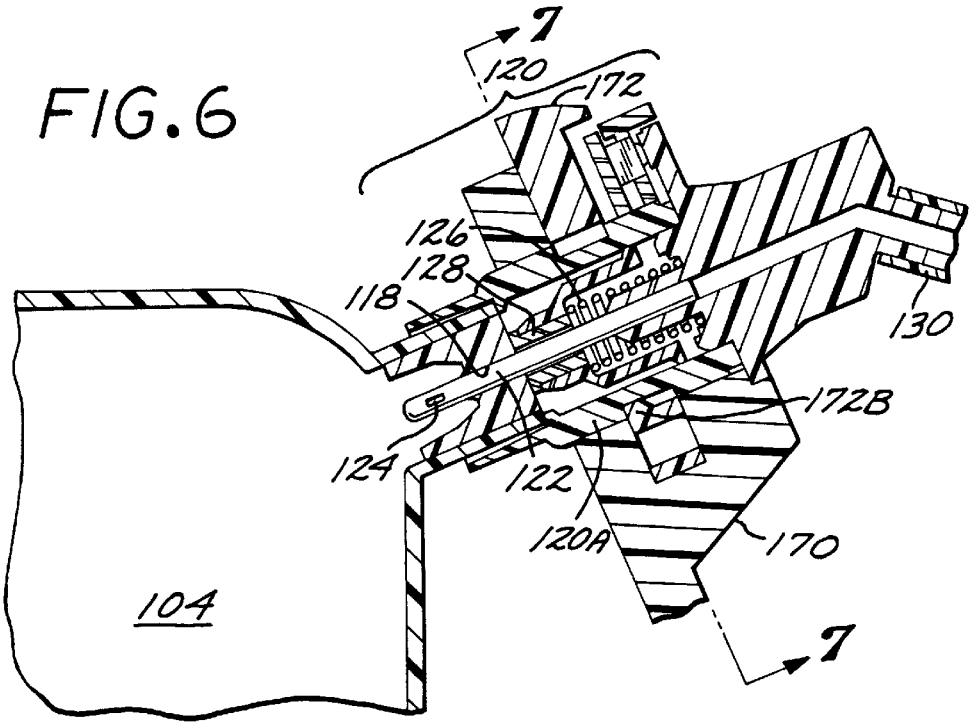
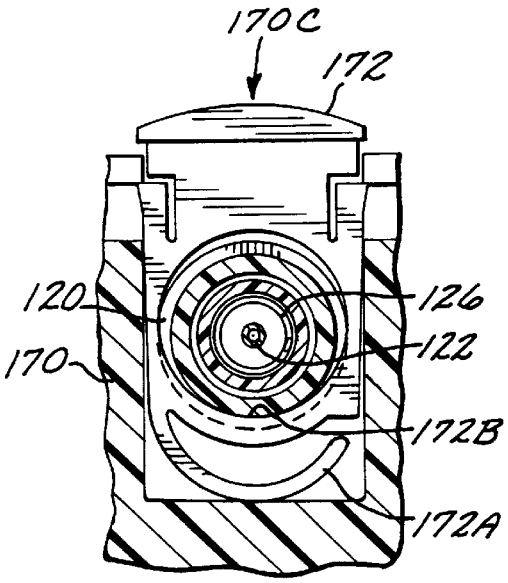
FIG. 7
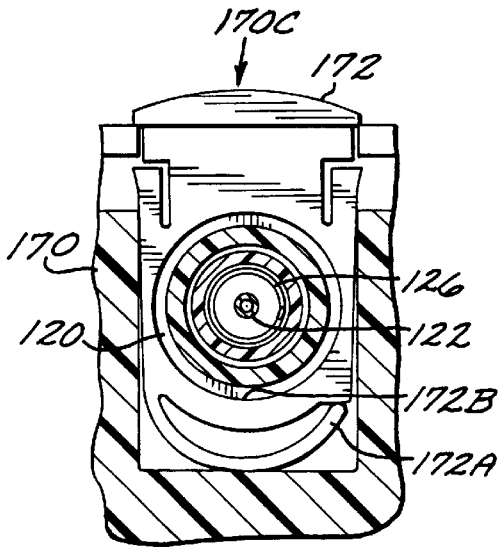
FIG. 8

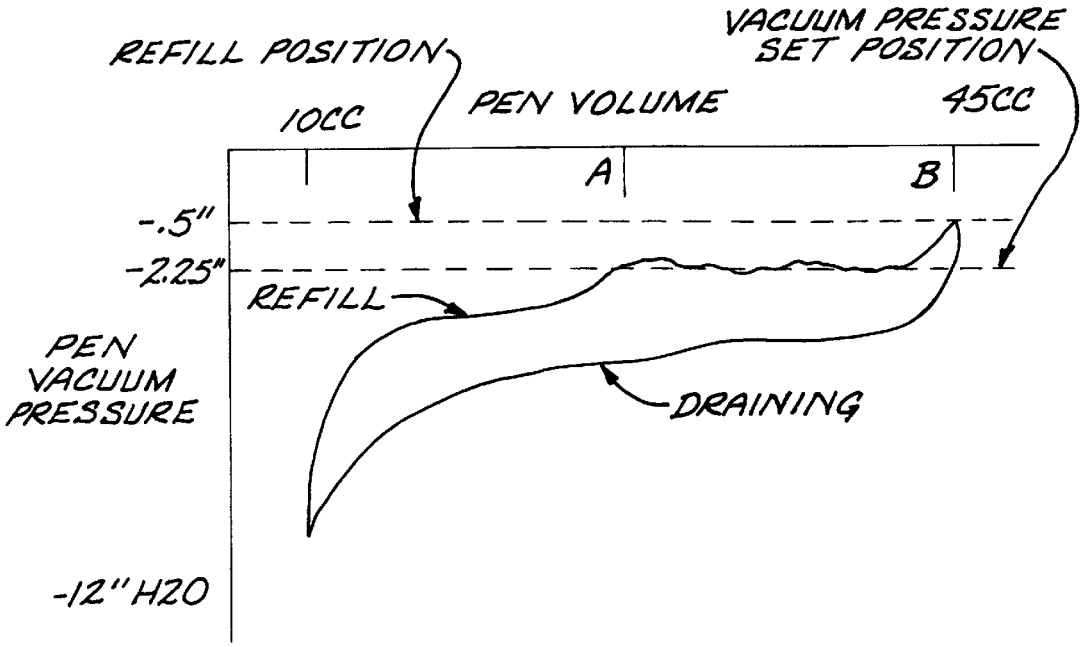
FIG. 9
FIG. 10
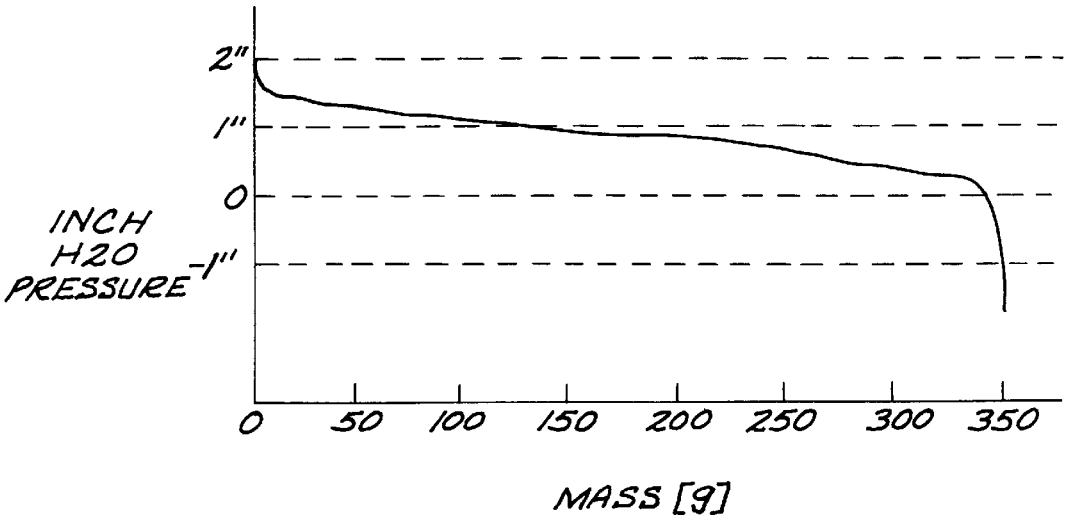

FIG.16
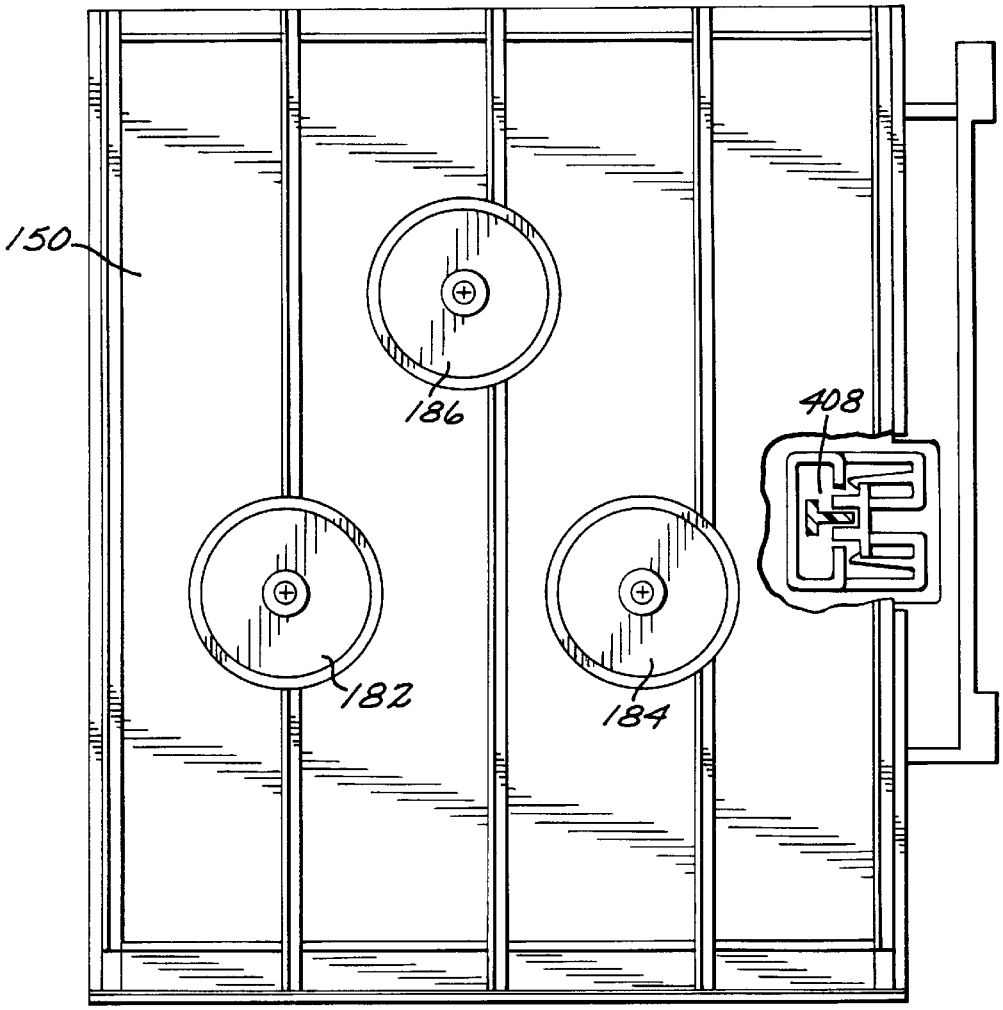
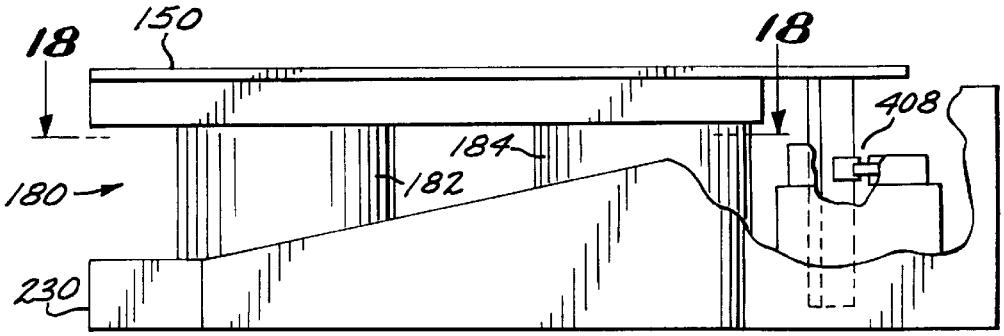
FIG.17

VARIABLE PRESSURE CONTROL FOR INK REPLENISHMENT OF ON-CARRIAGE PRINT CARTRIDGE

CROSS-REFERENCE TO RELATED APPLICATIONS

This is a continuation-in-part of application Ser. No. 08/615,903, filed Mar. 14, 1996, INKJET PRINT CARTRIDGE HAVING AN INK FILL PORT FOR INITIAL FILLING AND A RECHARGE PORT WITH RECLOSEABLE SEAL FOR RECHARGING THE PRINT CARTRIDGE WITH INK, now U.S. Pat. No. 5,777,648, a continuation-in-part of application Ser. No. 08/454,975, filed May 31, 1995, CONTINUOUS REFILL OF SPRING BAG RESERVOIR IN AN INK-JET SWATH PRINTER/PLOTTER, U.S. Pat. No. 5,745,137 by Joseph E. Scheffelin et al., (the "'975 application") the entire contents of which are incorporated herein by this reference.

This application is related to the following commonly assigned, co-pending applications, the entire contents of which are incorporated herein by this reference:

- Application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al.
- Application Ser. No. 08/810,840, filed Mar. 3, 1997, PRINTING SYSTEM WITH SINGLE ON/OFF CONTROL VALVE FOR PERIODIC INK REPLENISHMENT OF PRINTHEAD, by Max S. Gunther et al.
- Application Ser. No. 08/805,861, filed Mar. 3, 1997, APPARATUS FOR PERIODIC AUTOMATED CONNECTION OF INK SUPPLY VALVES WITH MULTIPLE PRINTHEADS, by Ignacio Olazabal et al.
- Application Ser. No. 08/726,587, filed Oct. 7, 1997, INKJET CARTRIDGE FILL PORT ADAPTER, Robert J. Katon et al.

TECHNICAL FIELD OF THE INVENTION

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced related applications, entitled SPACE-EFFICIENT ENCLOSURE SHAPE FOR NESTING TOGETHER A PLURALITY OF REPLACEABLE INK SUPPLY BAGS, PRINTING SYSTEM WITH SINGLE ON/OFF CONTROL VALVE FOR PERIODIC INK REPLENISHMENT OF PRINTHEAD, and APPARATUS FOR PERIODIC AUTOMATED CONNECTION OF INK SUPPLY VALVES WITH MULTIPLE PRINTHEADS, describe certain features of this new ink delivery system.

This invention optimizes the performance of this new off-carriage, take-a-gulp ink delivery system. In this type of IDS, a print cartridge that uses an internal spring to provide vacuum pressure is intermittently connected to an ink reservoir located off the scanning carriage axis. Starting with a "full" print cartridge, the printer will print a variety of plots while monitoring the amount of ink used. After a specified amount of ink has been dispensed, the carriage is moved to a refill station for ink replenishment. In the refill station, a valve is engaged into the print cartridge, thus connecting the ink reservoir to the print cartridge and opening a path for ink to flow freely. Using only the vacuum pressure present in the print cartridge, ink is "pulled" into the print cartridge from the reservoir.

Print cartridge vacuum pressure varies with the amount of ink contained in the print cartridge. Typically, low ink volume relates to high vacuum pressure and high ink volume is associated with low vacuum pressure. The vacuum pressure-ink volume curve exhibits hysteresis, in that a different vacuum pressure is realized in the print cartridge during printing (ink volume reduction) than when refilling (ink volume increase) for a given ink volume. Additionally, the refill vacuum pressure curve contains several relative peaks or "bumps" whereby several ink volumes can yield the same vacuum pressure. This poses a significant problem for this type of self regulating refill system where the flow of ink into the print cartridge stops when the vacuum pressure in the print cartridge is equal to the distance the ink reservoir is offset below the print cartridge. Thus, for a given offset distance, the print cartridge will always refill to the smallest volume that yields a pressure equal to the offset distance. These small "topped-off" refill volumes are unpredictable and often quite small (roughly half the print cartridge reservoir volume), and this is undesirable.

SUMMARY OF THE INVENTION

To circumvent this underfilling problem, the reservoir location is actively moved up and down in a vertical motion. After engaging the valve into the print cartridge, the reservoir is placed very close to the print cartridge (the top of the ink reservoir is roughly ½" below the print cartridge nozzles). With this reservoir location, the offset distance is small enough such that ink continues to flow into the print cartridge regardless of the presence or magnitude of the pressure-volume curve bumps. Additionally, the decreased offset distance increases the acceleration of the ink in the tubes which results in a faster refill time. However, at this location the print cartridge is overfilled in that, the vacuum pressure in the print cartridge reservoir is too small to ensure high print quality. To place the vacuum pressure in the appropriate range, the reservoir is lowered which results in a small amount ink moving back into the reservoir. This slight reduction in ink volume raises the vacuum pressure into the appropriate range.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

FIG. 9 is a graph showing pen vacuum pressure as a function of the volume of ink in the internal reservoir of an exemplary print cartridge, during ink draining (printing) and refilling operations.

FIG. 10 is a graph illustrating the pressure within an exemplary off-carriage ink reservoir bag as a function of the volume of ink within the bag.

FIG. 12 shows the valve structure in a disengaged position. FIG. 13 shows the valve structure moved into an engaged position.

FIG. 16 is a partially broken-away top view of the refill platform.

FIG. 17 is a side view of the platform of FIG. 16.

DETAILED DESCRIPTION OF THE PREFERRED EMBODIMENT

Figure 1:
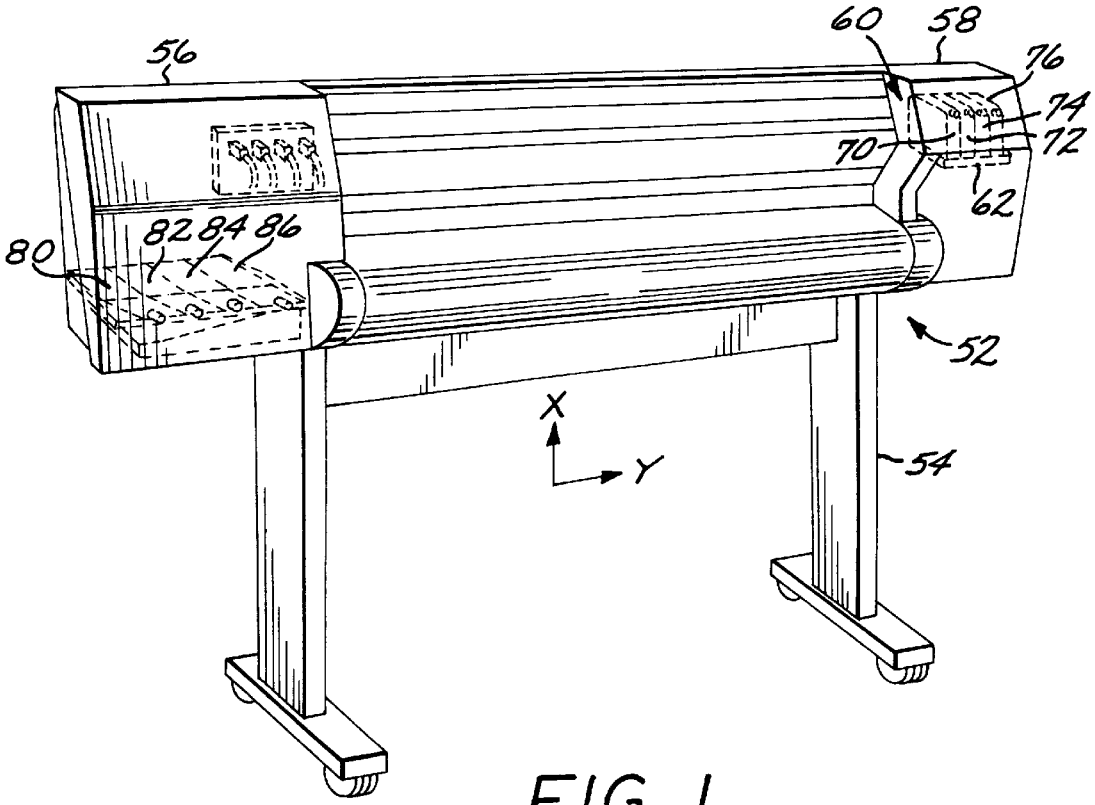
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage slide rod. A print medium such as paper is positioned along a vertical or media axis by a media axis drive mechanism (not shown). As is common in the art, the media drive axis is denoted as the 'x' axis and the carriage scan axis is denoted as the 'y' axis.

Figure 3:
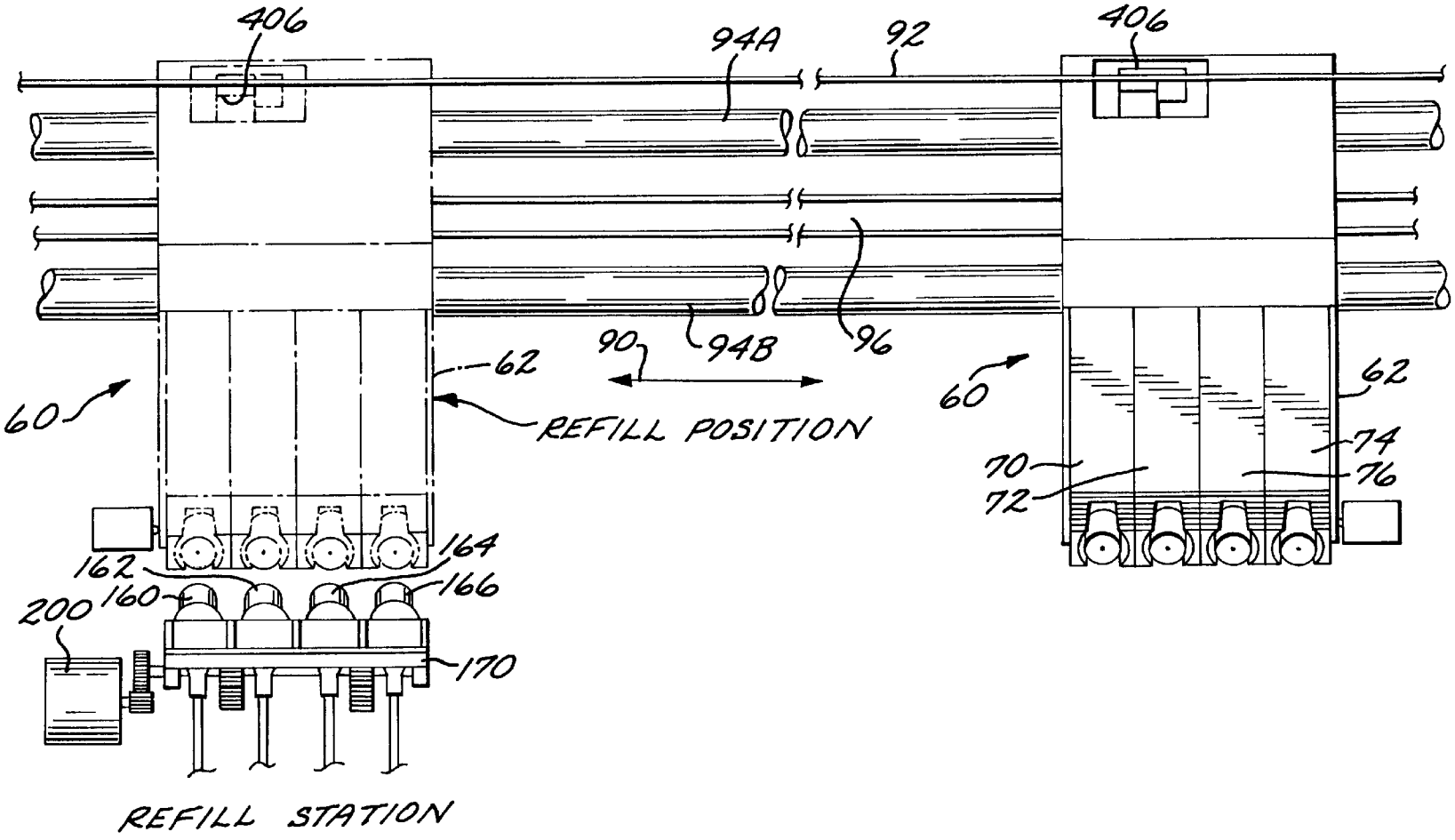
FIG. 3 is a top view showing the printer carriage and refill station.
Figure 4:
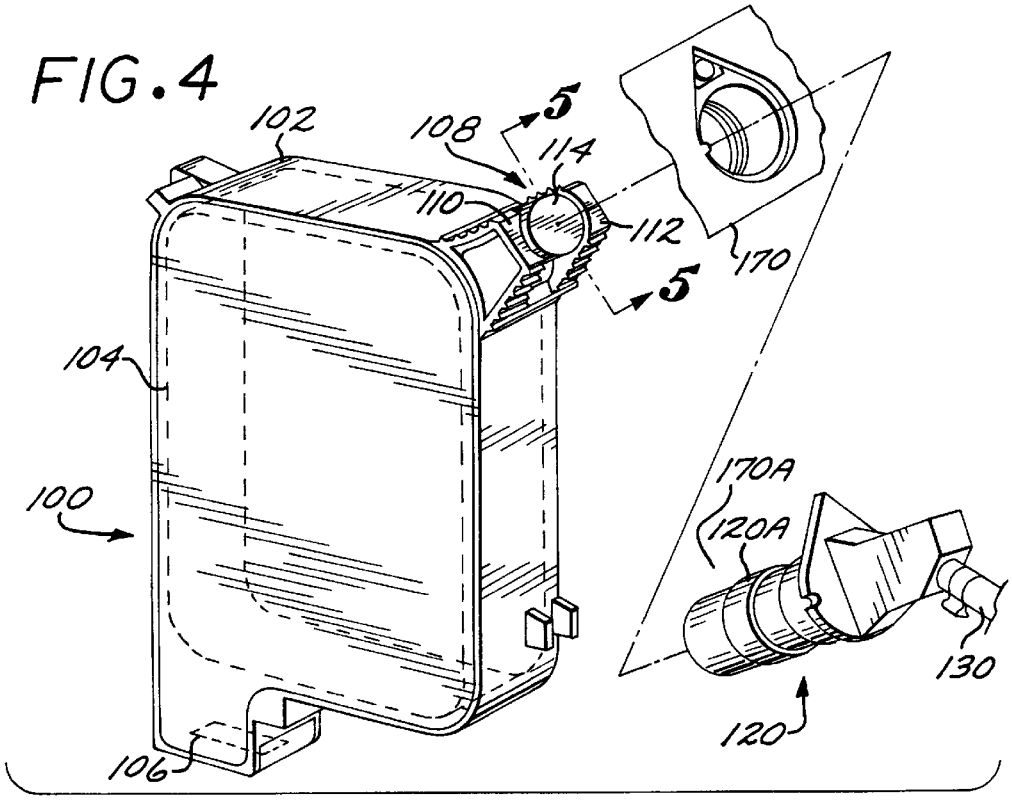
FIG. 4 is an isometric view of an ink-jet print cartridge usable in the system of FIG. 1, with a refill arm portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 94B, 94A. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a print head cleaner. The ink reservoir includes a bag holding 370 ml of ink, with a short tube and refill valve attached. Details of a ink reservoir bag structure suitable for the purpose are given in co-pending application Ser. No. , Attorney Docket No. 10960326, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a valve holder arm 170, also behind the left door, as will be described below. The print cartridge in this exemplary embodiment includes a 300-nozzle, 600 dpi printhead, with an orifice through which it is refilled. The head cleaner (not shown) includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 15.5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
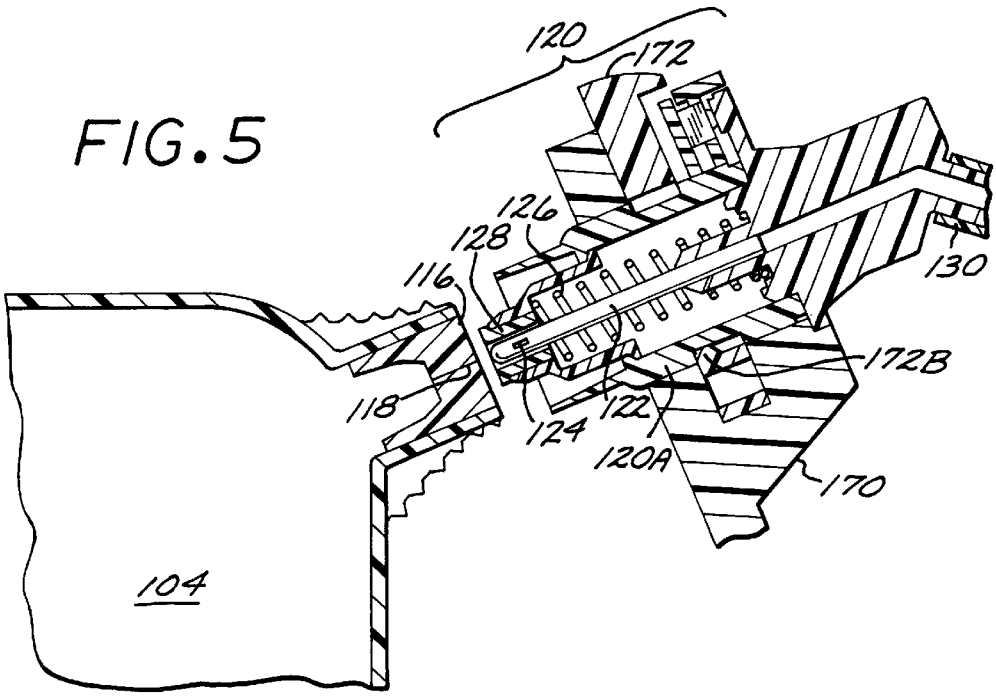
FIG. 5 is a cross-sectional view taken along line 5—5 of FIG. 4, showing the valve structure in a disengaged position relative to a refill port on the print cartridge.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve humidor 128 tightly fits about the needle, and is biased by a spring 126 to a valve closed position shown in FIG. 5. When the structure 120 is forced against the port 116, the humidor is pressed up the length of the needle, allowing the needle tip to slide into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the humidor 128. The opening 118 will close as well due to the elasticity of the material 116, thereby providing a self-sealing refill port for the print cartridge. FIGS. 4–8 illustrate a locking structure 172 for releasably locking the valve 120 into the valve holder arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on 172 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application. The back pressure curves of the cartridge exhibit hysteresis. FIG. 9 illustrates a typical vacuum pressure-ink volume curve for the print cartridge employed in the system of FIG. 1. It is seen that the ink draining back pressure curve is different from the ink refill back pressure curve, and that the refill curve has several relative peaks or "bumps". If the off-carriage reservoir were held at a constant height relative to the print cartridge during refill (i.e. with the cartridge refill port connected to the valve structure 120) and which gave the correct vacuum pressure for printing, it is highly likely that the print cartridge would fill only to the smaller volume indicated at A on the refill curve in FIG. 9.

In accordance with the invention, the off-carriage ink reservoirs 80–86 are placed on a variable height refill platform 150, which can place the off-carriage reservoirs at an up position, the "refill" position, to less than one inch below the cartridge printhead nozzles. At this position, with increased pressure head at the reservoir due to its elevated position, the print cartridge reservoir will refill to the larger volume indicated at B on the refill curve in FIG. 9. Because this would result in a print cartridge vacuum pressure which is too low to provide high quality printing, the position of the off-carriage reservoir is subsequently lowered with respect to the printhead nozzles, allowing a small amount of ink, e.g. on the order of 1–3 cc of ink in an exemplary embodiment, to flow from the print cartridge reservoir 104 back through the refill tube 130 into the off-carriage reservoir, moving the vacuum pressure into the appropriate range along the ink draining curve of FIG. 9. The refill valve structure 120 can then be disconnected from the cartridge refill port, and the printing system can proceed with printing operations with a print cartridge that has been refilled with ink.

The pressure head supplied at the output port of the off-carriage ink reservoir will also vary as the volume of ink within the bag is depleted. FIG. 10 illustrates the relationship for an exemplary ink reservoir bag. As the volume of ink is depleted, the pressure decreases. This pressure decrease presents an added problem in refilling print cartridges, since the rate of ink flow will decrease as the volume of ink decreases. The variable height refill platform addresses this problem as well, and ensures that each off-carriage reservoir bag can be virtually depleted of ink, by moving the bag higher in relation to the print-head nozzles to increase the pressure head, thus maximizing the pressure differential that drives the flow in ink into the cartridges.

An objective of the refill platform in accordance with the invention is to use the hysteresis curve of FIG. 9 and move all the off-carriage reservoirs up and down in order to provide the optimal refill of the on-carriage print cartridge reservoirs, i.e., to refill the print cartridges with larger quantities of ink and in a lesser period of time.

Figure 2:
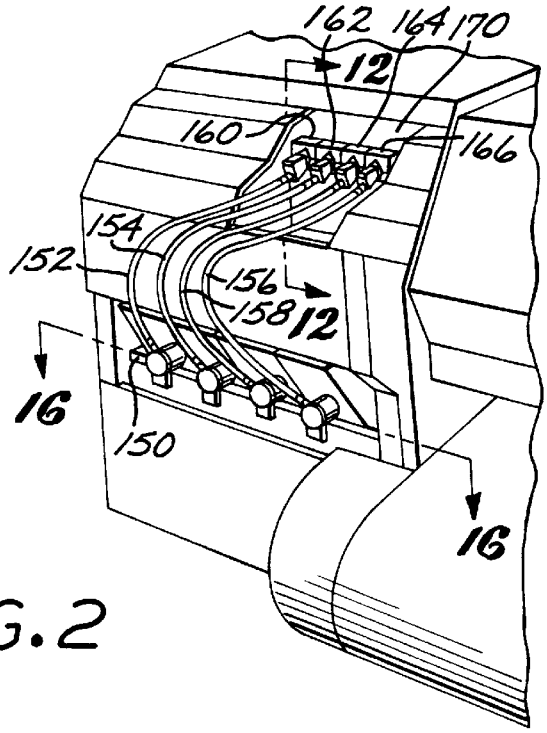
FIG. 2 is an enlarged view of a portion of the system of FIG. 1, showing the refill station.

In the exemplary system of FIG. 1, the refill platform 150 is in the left housing 56 of the printer 50 as shown in FIG. 2. A cam system 180 is employed to raise and lower the platform, with three cams 182, 184, 186 placed at 120 degrees. A stepper motor 188 drives a gear train 190 to actuate the cam system.

The four off-carriage ink reservoirs 80–86 are supported on the platform 150. Short flexible tubes 152, 154, 156 and 158 connect between ports 80A–86A of corresponding reservoirs 80–86 and needle valve structures 160, 162, 164 and 166 supported at a valve holder arm 170. These needle valve structures each correspond to the valve structure 120 of FIGS. 4–8.

Figure 11:
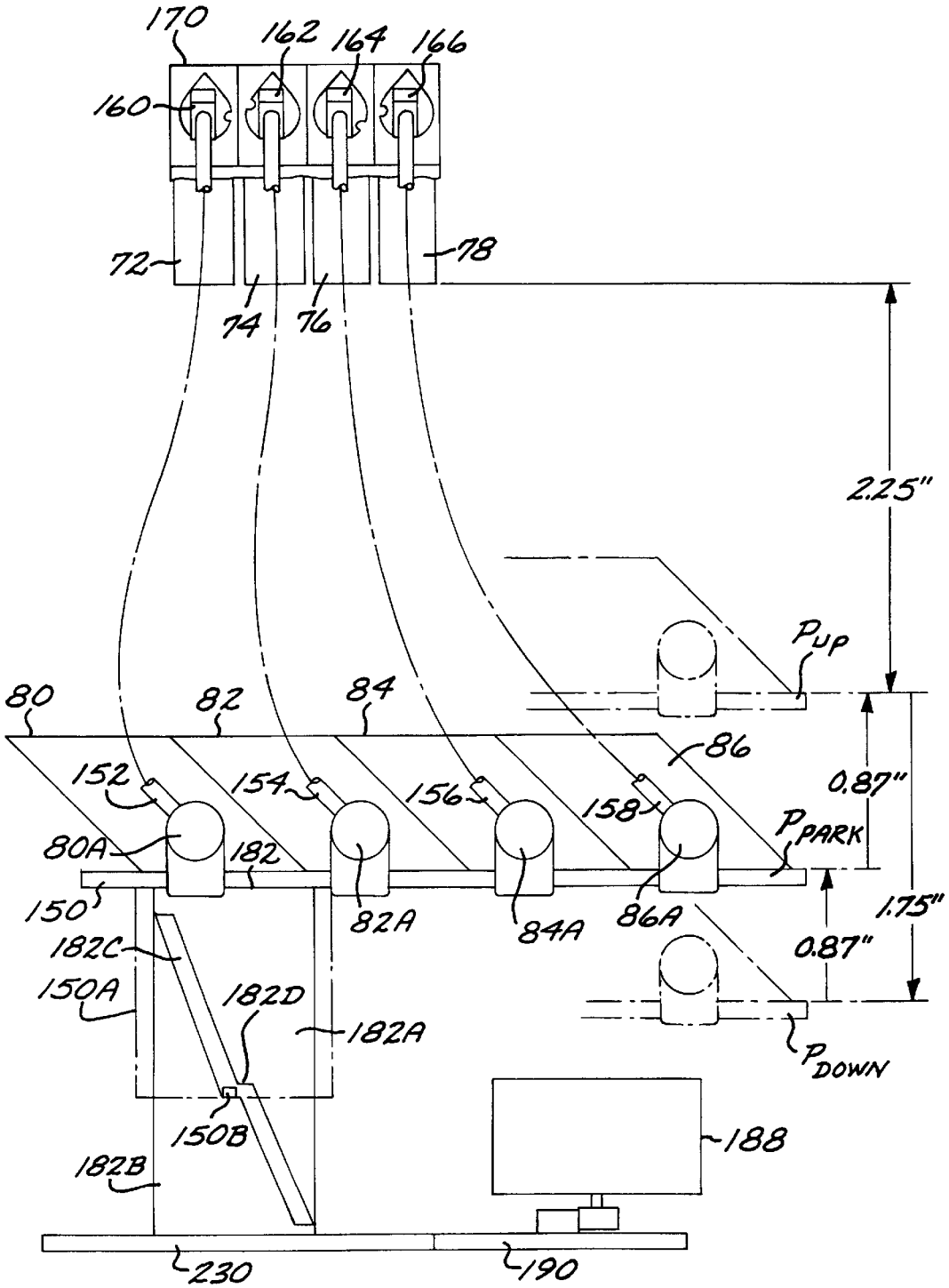
FIG. 11 is a simplified front plan view showing elements of the ink refill station, and with the reservoir platform at different heights.

The refill platform 150 is an elevator that holds the four reservoirs and can be moved up and down by the stepper motor drive. The refill platform has 3 stable positions, as shown in FIG. 11. The up position $P_{up}$, i.e. the one with highest elevation, is used to over-refill the print cartridges 70–76. Every time a print cartridge needs to be refilled, the reservoirs will be lifted to this position and will be kept there during the refill time. The objective of this position is to force a back pressure equilibrium between −0.5 in $H_2O$ and −2.5 in $H_2O$ (depending on the quantity of ink inside the internal reservoir 104) in the cartridge, so that every cartridge can drink as much ink as possible. Every cartridge will drink a different amount of ink depending on the quantity of ink already consumed, i.e. the amount of ink remaining in the off-carriage reservoir.

The down position $P_{down}$ of the refill platform 150 is the stabilization position; the pressure inside the print cartridge reservoir is decreased by roughly the distance the off-carriage reservoirs are moved down.

The pressure in the print cartridge reservoir will stabilize to a value equal to the offset (negative) distance between the printhead nozzles and the platform, i.e. the bottom of the off-carriage reservoir, plus the amount of pressure in the off-carriage reservoir. For example, when the platform is in the fill position $P_{up}$, the offset distance is −2.25 inches. Suppose that the reservoir is at a volume that gives it an outlet pressure of +0.5 inches (in inches of $H_2O$) at the reservoir fill port. The resulting pressure in the cartridge reservoir when filled will be −2.25 inches+0.5 inches=−1.75 inches (all in inches of $H_2O$). Now, during the stabilization period, the reservoir and platform move down to the $P_{down}$ position 4 inches below the printhead nozzles, which in an exemplary embodiment is 1.75 inches below the $P_{up}$ position. This move effectively changes the print cartridge vacuum pressure by −1.75 inches, so the vacuum pressure is −1.75 inches −1.75 inches =−3.5 inches (in inches of $H_2O$) of vacuum pressure.

The middle position $P_{park}$ of the refill platform 150 is used to load and remove the off-carriage reservoirs 80–86, and it is the park position.

Back pressure (in inches of $H_2O$) during refill with the refill valve structure engaged with the refill port of the cartridge is greater than −0.5 inches, and less than −2.5 inches. After refill the back pressure is greater than −2.25 inches and less than −4 inches. During printing operation, the back pressure is greater than −2 inches (of $H_2O$), and as ink is depleted from the print cartridge reservoir, approaches about −8 to −9 inches of $H_2O$.

After two minutes at the up position, the refill platform lowers the reservoir to the down position, which is 4 inches below the printheads, to set the back pressure in the cartridges to an operational range, and keeps the reservoirs at this down position for about 15 seconds. Back pressure will decrease in the cartridges, but the volume of ink inside the internal reservoirs will decrease only a little (because the pressure is moving in the quasi-vertical area of the back-pressure curves).

Thereafter, the on-carriage cartridges 70–76 are disconnected from the refill station valves, and the refill platform 150 is moved to the middle position $P_{park}$, leaving it ready for the next refill or replacement.

Figure 13:
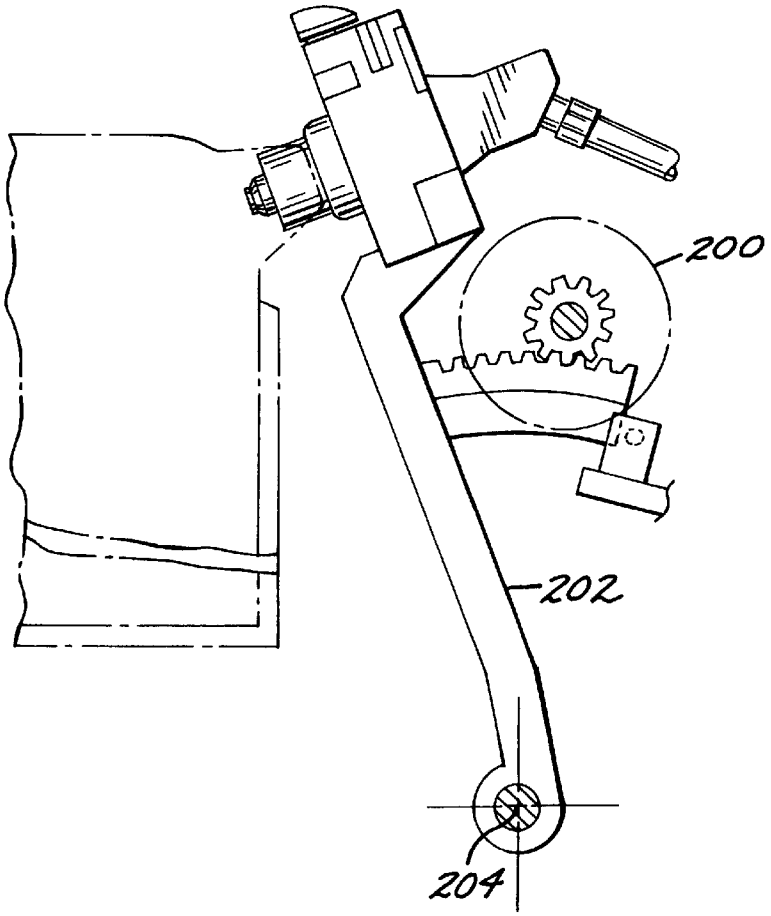
FIGS. 12 and 13 illustrate in simplified side view the mechanism for engaging and disengaging the valve structure from the print cartridge refill ports at the refill station.
Figure 12:
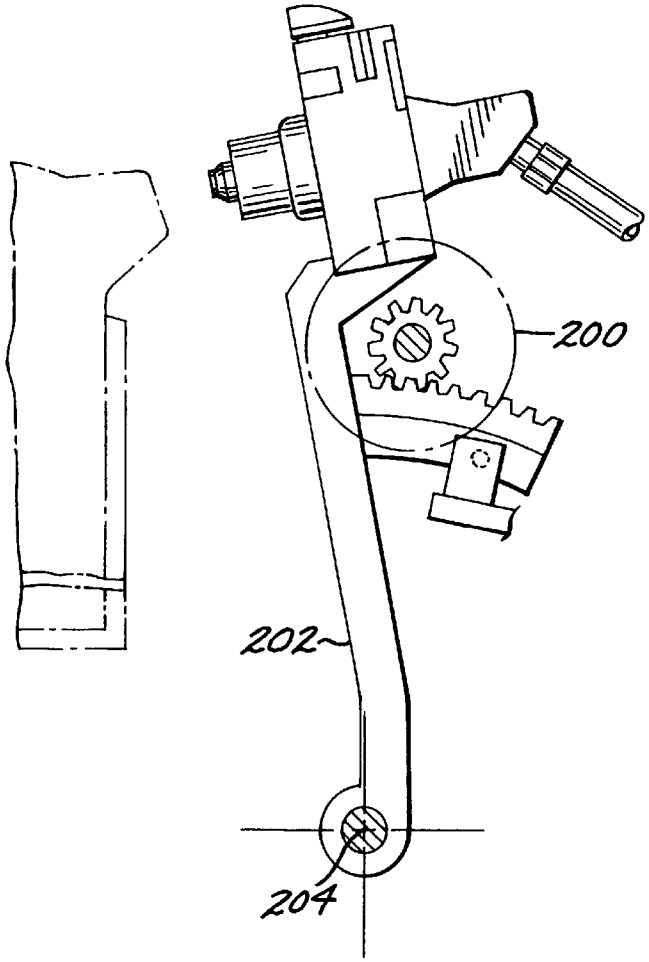

To perform a refill the carriage assembly 60 is moved to the refill station where the four off-carriage reservoirs 80–86 are connected to the corresponding print cartridges 70–76 via the shut-off valves 160–166. The above referenced pending application, Attorney Docket No. 6096026, PRINTING SYSTEM WITH SINGLE ON/OFF CONTROL VALVE FOR PERIODIC INK REPLENISHMENT OF PRINTHEAD, by Max S. Gunther et al., provides additional details of the shut-off valves. Another form of shut-off valving suitable for the purpose is described in the above referenced pending application, Attorney Docket No. 10960552, INKJET CARTRIDGE FILL PORT ADAPTER, Robert J. Katon et al. The connection of the reservoirs is accomplished by turning a stepper motor 200 that advances a lever 202 on which the valve structures and valve holder arm 170 are mounted, as shown in FIGS. 3 and 12–13. A system suitable for moving the valves into and out of engagement with the refill ports is more fully described in co-pending application Ser. No. , Attorney Docket No. 6096023, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridge, the back pressure decreases to a point where the print cartridge can no longer pull additional ink from the cartridge and the refill stops. The pressure at which the flow of ink stops is governed by the distance offsetting the print cartridge and the off-carriage reservoir. The farther below the print cartridge the reservoir is located, the greater the final vacuum pressure in the print cartridge and the lower the resulting volume of ink in the print cartridge internal reservoir.

Back pressure—ink volume curves vary from print cartridge to print cartridge. This can result in larger variations in the refilled volume. To help remove this variation, the distance between the print cartridge and the off-carriage reservoir is actively controlled. At the beginning of the refill process, the reservoirs are placed very close to the print cartridges which causes ink to move into the cartridges relatively quickly. In this high position, the resulting back pressure is too low to ensure good print quality. The back pressure is then set to be within a printable range by lowering the ink reservoir which causes a small amount of ink to travel back into the reservoir from the print cartridge and thus increases the back pressure. By over-filling the print cartridges and then removing a small amount of ink, the topped-off volume for all print cartridges is less variable.

The entire sequence of the refill operation can be performed relatively quickly. Typical event time requirements for the refill process are the following: move the carriage to the refill station—5 seconds; engage the valves into the refill ports of the print cartridges—15 seconds; wait during refill with the platform at $P_{up}$—120 seconds; move the platform down to $P_{down}$—15 seconds; disengage the valves—10 seconds. This provides an estimated total time for the refill operation of 180 seconds for this exemplary embodiment. This is a relatively short time period for the refill. Another advantage is that the refill can be performed without the need to remove and replace the print cartridges from the carriage, thus further contributing to the efficiency of the refill process. Yet another advantage is that all of the print cartridges are simultaneously replenished with ink during the refilling process, without removing the print cartridges from the carriage.

Another feature of the refill technique in accordance with an aspect of the invention is that there is no need to sense ink level in the course of ink replenishment. The platform is simply positioned at $P_{up}$ for a predetermined time period, i.e. at a position to provide the necessary pressure head to fill the print cartridge reservoir, and then following expiration of this time period, the cartridge has been reliably filled.

A refill sequence is triggered in the following manner. A goal of this exemplary refill system embodiment is to have at least 18 cc of deliverable ink in the reservoir of each on-carriage print cartridge at the end of a refill. Assuming this goal is met, the amount of ink in the print cartridge after any print can be determined by counting the number of drops fired since the last refill, and relating the number of drops to a consumed ink volume. This can be done by assuming that all drops fired from the on-carriage cartridge printhead 106 are statistically of worst case, large size, and use this worst case size to compute an estimate of consumed ink volume. An additional goal of the refill system is to ensure that the user can complete a worst case 100% coverage, i.e. 100% dense, E-size print. The volume of ink required for this print is roughly 11.5 cc. Hence, a refill could be triggered when the computed print cartridge ink volume falls below 11.5 cc. Alternatively, the drop volume can be predicted based on actual print conditions, e.g. taking into account the particular print mode and other factors affecting the actual drop volume, and then keep a running total of the consumed ink volume. The refill could also be triggered when the predicted consumed ink volume exceeds some value, say 4 cc, rather than triggering when an estimated remaining ink volume in the cartridge is reached.

Figure 14:
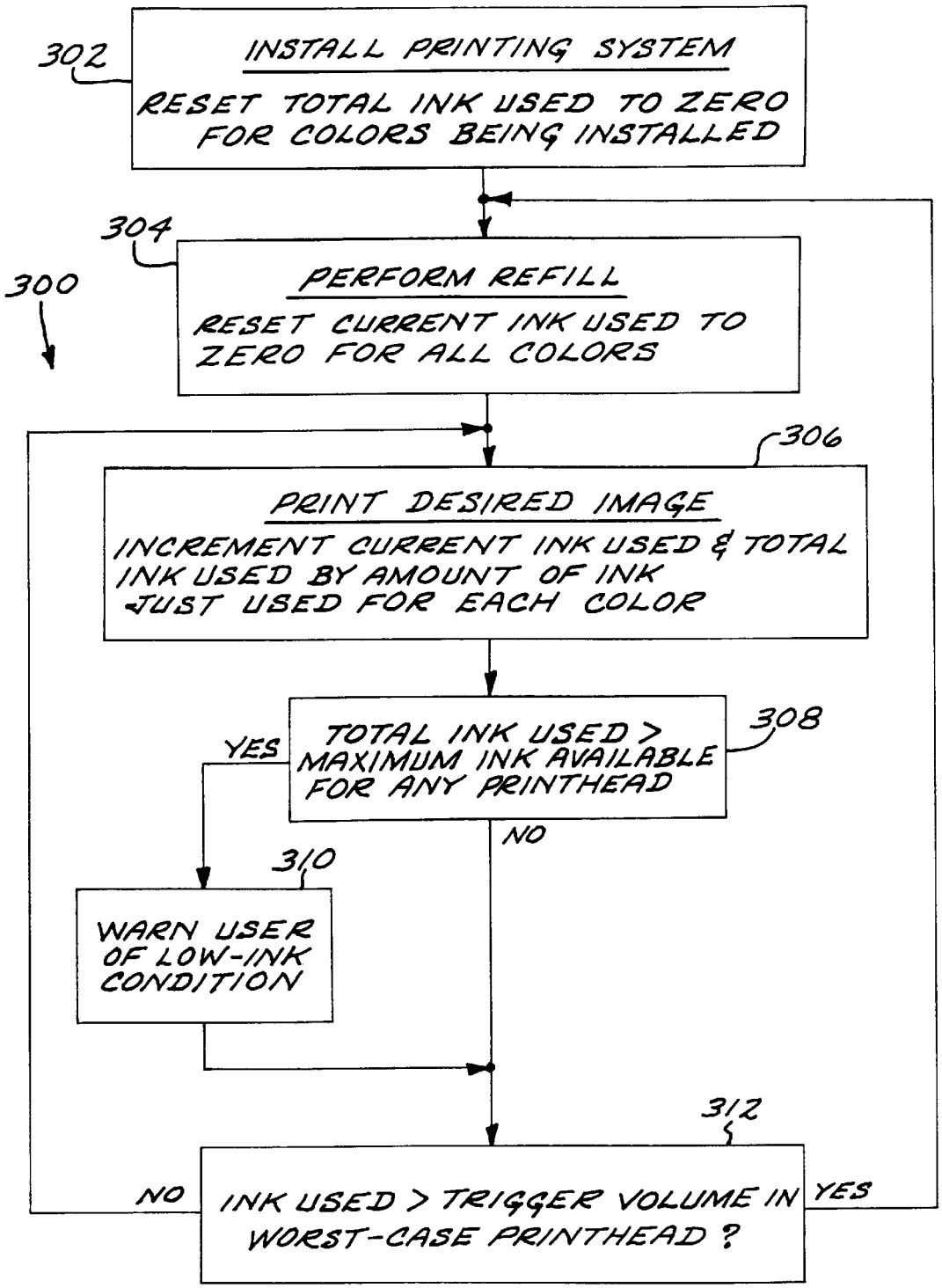
FIG. 14 is a simplified flow diagram illustrating the operation of the printing system of FIG. 1 in intermittently refilling the print cartridges.

The system operation sequence 300 is generally shown in FIG. 14. At step 302, immediately after the installation of a cartridge, printhead and head cleaner set, the controller resets the parameter number for the total ink used by this IDS to zero. At step 304, a refill operation is performed, and a parameter for the current ink volume used since the last refill is reset to zero for all colors. This will bring all on-carriage print cartridges to a known level of ink. This means that all print cartridges should be above the Minimum Usable Ink After Refill (MUIAR) target volume of 18.5 cc of deliverable ink in the printhead.

At step 304, the system prints the desired image, with the controller incrementing the parameter values for the total ink volume used and the current ink volume used, for each color.

Step 308 is performed after the print job has been completed, and is a test to compare the total ink used parameter to the predetermined threshold value for the maximum ink available for any printhead. If the total ink volume used for any IDS exceeds the threshold, the user is warned of a low-ink condition at step 310, typically through a front panel message. Operation proceeds to step 312. Here, another test is performed.

A refill is triggered at step 312 based on the current amount of ink used. In the exemplary embodiment illustrated, if the amount of ink consumed since the last refill by any print cartridge, as determined by drop counting, exceeds the trigger volume, a refill is triggered.

After the refill sequence is complete, the platform is moved to the park position. After another refill sequence begins, and the valves have been connected to the print cartridge refill ports, the platform is raised to the up position.

Figure 15:
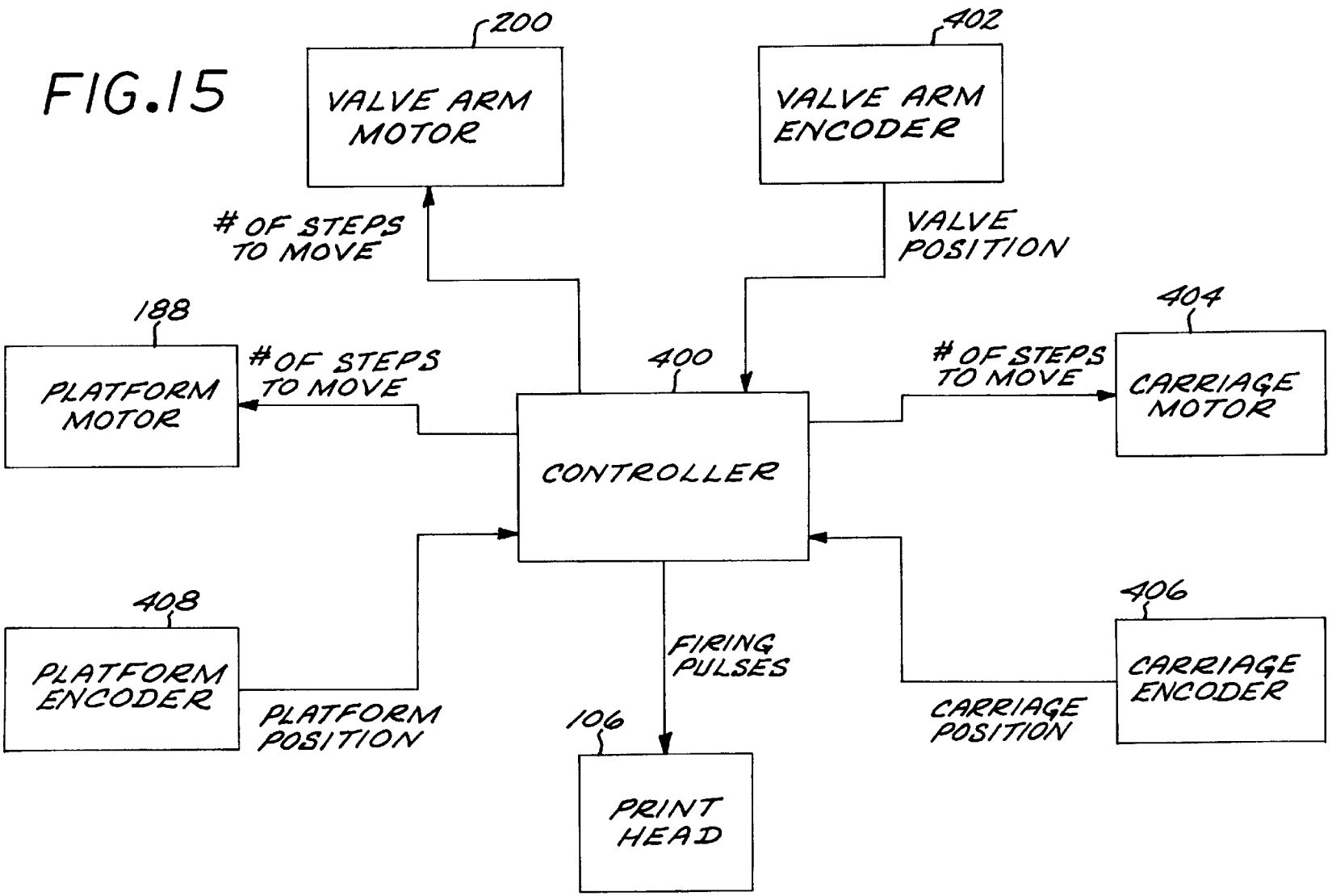
FIG. 15 is a simplified functional block diagram of the system controller and controlled elements of the printing system of FIG. 1.
Figure 18:
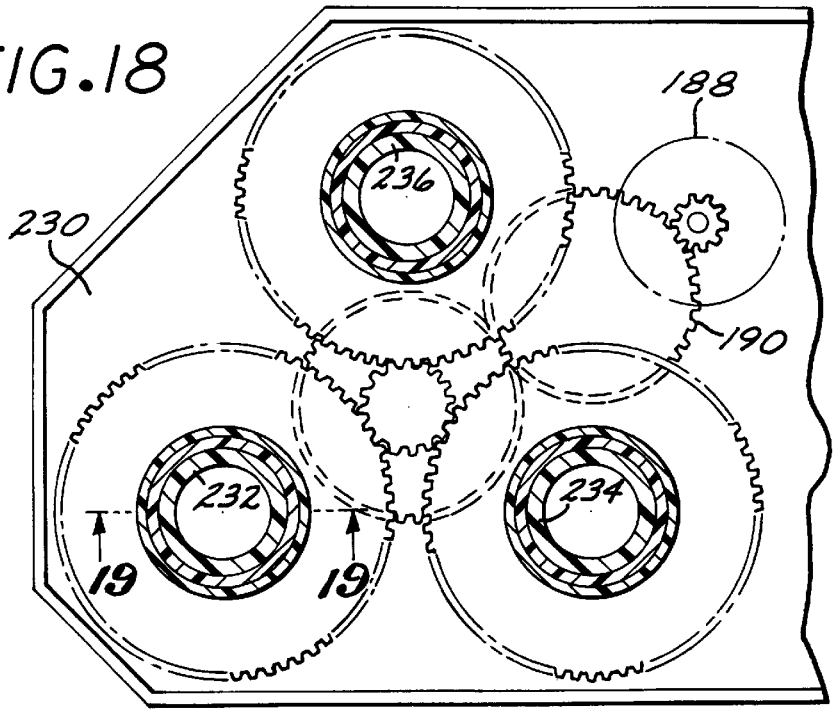
FIG. 18 is a cross-sectional view taken along line 18—18 of FIG. 17.

FIG. 15 is a simplified functional block diagram showing the system controller 400 and various elements of the drive and control system. The controller 400 provides firing impulses to the firing chamber resistors of the printhead 106, and counts the number of drops fired for each color. The controller controls the carriage stepper drive motor 404, receiving carriage position data from a carriage encoder sensor 406. The controller also issues drive signals to the platform motor 188 and valve arm motor 200, receiving platform and valve position data from encoders 408 and 402.

Figure 19:
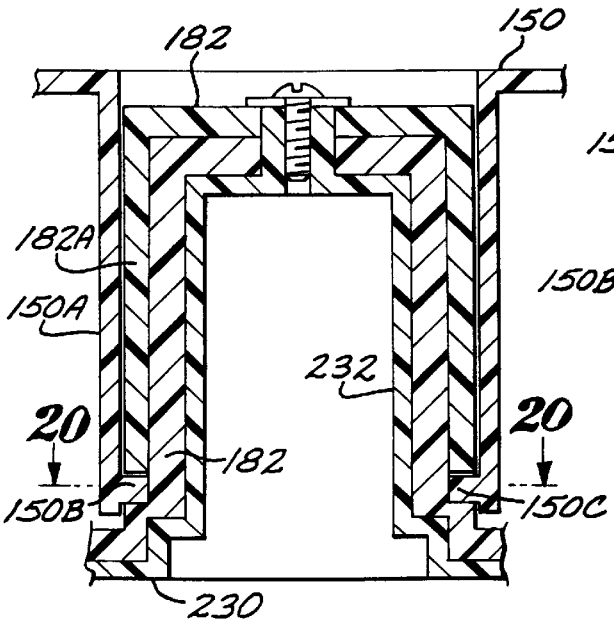
FIG. 19 is a cross-sectional view taken along line 19—19 of FIG. 18.
Figure 20:
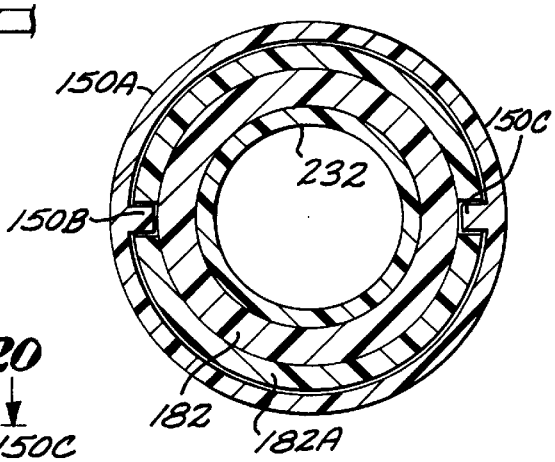
FIG. 20 is a cross-sectional view taken along line 20—20 of FIG. 19.

FIGS. 16–20 show the platform 150 and elevator structure in further detail. The cam system 180 is employed to raise and lower the platform 150, with three cams 182, 184, 186 placed at 120 degrees. A stepper motor 188 drives a gear train 190 to actuate the cam system. A refill station plate 230 supports the cam system and motor. The plate 230 includes three upwardly extending hollow cylindrical bosses 232, 234 and 236. FIGS. 19 and 20 show boss 232 and corresponding cam 182. The platform 150 also defines a downwardly extending cylindrical boss 150A, having extending from a distal end cam surfaces 150B and 150C. The cam surfaces ride in slots 182C (FIG. 11) defined by the cam 182. The cam 182 is in turn defined by upper and lower members 182A and 182B, with lower member 182B also defining a gear 182D. As the motor 188 turns, gear 182D is also turned, causing the cam surfaces 150B, 150C to follow the slot 182C. The upper and lower positions are defined by the extremities of the slot 182C (FIG. 11). The park position is defined by the jog 182D formed in the slot midway between the extremities.

The refill mechanism provides a concern during start up of the printer. Suppose that the power is inadvertently shut off during a refill and that the valves are still engaged in the printheads. It is prudent to assume that the valves will be engaged in the print cartridges for a long time. This implies that, upon startup and initialization, the carriage cannot be immediately moved, since the valves may still be engaged, and serious damage could occur. Additionally, since the print cartridges are assumed to be very full, since the machine has sat with valves engaged for a long time and the platform has not been moved down, the refill cycle needs to be completed by moving the platform down to remove ink and set the print-head back pressure. Thus, during startup, (1) the platform is moved to the down position to set the back pressure, then (2) the valves are disengaged. Lastly, refill servicing should be performed to ensure print cartridge health.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of intermittently replenishing a supply of liquid ink in an on-carriage print cartridge in a printer/plotter, comprising the following steps:

providing the on-carriage print cartridge on a movable carriage, the print cartridge including a printhead and an internal reservoir for holding a supply of liquid ink under negative pressure;

providing the supply of liquid ink in said internal reservoir;

providing an off-carriage ink supply for intermittent connection to the internal reservoir of the print cartridge;

establishing an open ink flow path between the off-carriage ink supply and the print cartridge internal reservoir;

establishing an ink pressure head at the off-carriage ink supply sufficient to cause ink to flow from the off-carriage ink supply to the print cartridge internal reservoir and permitting ink to flow into the print cartridge internal reservoir from the off-carriage ink supply to replenish the ink supply in the internal reservoir, said step of establishing an ink pressure head comprising changing an elevation of the off-carriage ink supply relative to an elevation of the printhead to increase said pressure head and facilitate transfer of ink through said open flow path from the off-carriage ink supply to the print cartridge internal reservoir; and disconnecting said open ink flow path from said print cartridge internal reservoir while preserving a negative pressure within said internal reservoir.

2. The method of claim 1 further comprising the step of:

after replenishing the ink supply in the print cartridge reservoir and prior to said disconnecting of said ink flow path, reducing an effective ink pressure head to allow a small amount of ink to flow into the off-carriage ink supply from the print cartridge internal reservoir, setting the negative pressure in the internal reservoir to an appropriate pressure to ensure high print quality.

3. The method of claim 1 wherein said step of establishing the ink pressure head comprises positioning a container holding said off-carriage ink supply at an elevation which provides said ink pressure head sufficient to cause the ink to flow from the off-carriage ink supply to the print carriage internal reservoir.

4. The method of claim 1 wherein said steps of establishing the ink flow path, establishing the ink pressure head and permitting the ink to flow into the print cartridge internal reservoir from the off-carriage ink supply to replenish the ink supply in the internal reservoir are performed without removing the print carriage from the carriage.

5. The method of claim 1 wherein said step of permitting the ink to flow is performed for a predetermined time interval.

6. The method of claim 5 wherein said step of permitting the ink to flow is performed without any ink level sensing.

7. The method of claim 5 wherein said predetermined time interval does not exceed three minutes.

8. The method of claim 1 further characterized in that a plurality of ink-jet cartridges are provided on said movable carriage, and each cartridge includes a corresponding internal reservoir holding a supply of ink of a different color under negative pressure, a supply of ink is provided in each said internal reservoir, corresponding off-carriage ink supplies are provided for each said print cartridge, said step of establishing said open ink flow path includes establishing a respective open ink flow path between each said print cartridge and the corresponding off-carriage ink supply, and said step of establishing an ink pressure head and permitting ink to flow includes establishing said pressure head for each off-carriage supply and permitting the ink to flow into each said print cartridge internal reservoir from said corresponding off-carriage supply to replenish the ink supply in each said internal reservoir.

9. The method of claim 1 wherein said step of providing the on-carriage ink-jet print cartridge is further characterized in that the internal reservoir of the print cartridge is free of any ink absorbing material.

10. A method of ink-jet printing and intermittently replenishing a supply of liquid ink in an on-carriage print cartridge in a printer/plotter, comprising the following steps:

providing the on-carriage ink-jet print cartridge on a movable carriage, the print cartridge including an internal reservoir holding a supply of liquid ink under negative pressure;

providing a supply of liquid ink in said internal reservoir;

using the print cartridge to eject ink from a printhead to print an image on a recording medium;

moving the carriage to position the print cartridge at a refill station;

providing an off-carriage ink supply for intermittent connection to the internal reservoir of the print cartridge;

establishing an ink flow path between the off-carriage ink supply and the print cartridge internal reservoir;

increasing an ink pressure head at the off-carriage ink supply and permitting ink to flow into the print cartridge internal reservoir from the off-carriage ink reservoir to replenish the ink supply in the internal supply;

after replenishing the ink supply in the print cartridge reservoir, reducing the ink pressure head at the off-carriage ink supply to allow a small amount of ink to flow into the off-carriage ink supply from the print cartridge internal reservoir, setting a negative pressure in the internal reservoir to an appropriate pressure to ensure high print quality.

11. The method of claim 10 wherein said step of increasing the ink pressure head comprises positioning the off-carriage supply at a first elevation, and said step of decreasing the ink pressure head comprises positioning the off-carriage supply at a second elevation which is lower than the first elevation.

12. The method of claim 10 further comprising the step of disconnecting said ink flow path after said small amount of ink has flowed into the off-carriage supply from the print cartridge internal reservoir.

13. The method of claim 10 wherein said step of establishing the ink flow path includes connecting a valve structure to an ink replenishment port on the print cartridge, and said step of disconnecting the ink flow path includes disconnecting the valve structure from the ink replenishment port.

14. The method of claim 10 wherein said steps of establishing the ink flow path, establishing the ink pressure head and permitting the ink to flow into the print cartridge internal reservoir from the off-carriage ink supply to replenish the ink supply in the internal reservoir, and reducing said ink pressure head are performed without removing the print carriage from the carriage.

15. The method of claim 10 wherein said step of permitting the ink to flow is performed for a predetermined time interval.

16. The method of claim 15 wherein said step of permitting the ink to flow is performed without any ink level sensing.

17. The method of claim 10 wherein said step of providing the on-carriage ink-jet print cartridge is further characterized in that the internal reservoir of the print cartridge is free of any ink absorbing material.

18. An automated method of passively and intermittently refilling an on-carriage print cartridge in a printer/plotter, comprising the following steps:

providing the on-carriage print cartridge on a movable carriage, the cartridge including an internal reservoir holding a supply of ink under negative pressure;

moving the carriage to position the print cartridge at a refill station;

providing an off-carriage ink reservoir at the refill station for intermittent connection to the internal reservoir of the print cartridge;

connecting the off-carriage ink reservoir to the print cartridge internal reservoir via a valve arrangement;

positioning the off-carriage ink reservoir at an up position to increase an ink pressure head, and permitting ink to flow into the print cartridge internal reservoir from the off-carriage ink reservoir;

after replenishing the ink supply in the print cartridge reservoir, lowering the off-carriage ink reservoir to a lowered position to allow a small amount of ink to flow back into the off-carriage ink reservoir from the print cartridge internal reservoir to increase the magnitude of the negative pressure in the internal reservoir to an appropriate pressure to ensure high print quality.

19. A printer/plotter system employing a negative pressure ink-jet print cartridge, comprising:

the ink-jet print cartridge having a negative pressure ink reservoir for holding a supply of liquid ink under negative pressure, the print cartridge including an ink replenishment port;

the supply of ink in said negative pressure ink reservoir;

a carriage for holding the print cartridge;

a carriage scanning apparatus for driving the carriage along a carriage scan axis;

an off-carriage ink reservoir;

valve apparatus for intermittent connection of a fluid path between said off-carriage ink reservoir and said ink replenishment port of said print carriage at an ink replenishment station;

a platform structure for supporting the off-carriage ink reservoir; and apparatus for raising and lowering said platform structure to position the off-carriage ink reservoir at a first elevation position while said valve apparatus is connected, and at a second elevation position while said valve apparatus is connected.

20. The system of claim 19 wherein the negative pressure ink reservoir is free of any ink absorbing material.

* * * * *

UNITED STATES PATENT AND TRADEMARK OFFICE

CERTIFICATE OF CORRECTION

PATENT NO. : 5,992,985

DATED : November 30, 1999

INVENTOR(S) : Mark E. Young, et al.

It is certified that error appears in the above-identified patent and that said Letters Patent is hereby corrected as shown below:

At column 11, line 35, after "the print", delete "carriage" and insert in lieu thereof -cartridge--.

At column 12, line 46, after "the print", delete "carriage" and insert in lieu thereof --cartridge--.

Signed and Sealed this

Eleventh Day of July, 2000

*Attest:*

Q. TODD DICKINSON

*Attesting Officer*

*Director of Patents and Trademarks*